US007918119B2

(12) United States Patent
Shore

(10) Patent No.: US 7,918,119 B2
(45) Date of Patent: Apr. 5, 2011

(54) METHOD OF CONTROLLING THE SPEED OF A LAYING HEAD IN A ROLLING MILL

(75) Inventor: T. Michael Shore, Princeton, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 500 days.

(21) Appl. No.: 12/026,765

(22) Filed: Feb. 6, 2008

(65) Prior Publication Data

US 2008/0237383 A1 Oct. 2, 2008

Related U.S. Application Data

(60) Provisional application No. 60/909,548, filed on Apr. 2, 2007.

(51) Int. Cl.

| | |
|---|---|
| ***B21D 11/00*** | (2006.01) |
| ***B21F 3/02*** | (2006.01) |
| ***B21B 37/58*** | (2006.01) |
| ***B21C 47/10*** | (2006.01) |

(52) U.S. Cl. ..... 72/66; 72/10.3; 72/135; 242/361

(58) Field of Classification Search ..... 72/66, 67, 72/135, 371, 10.3, 443, 444; 242/361–361.4
See application file for complete search history.

(56) References Cited

U.S. PATENT DOCUMENTS

| | | | | |
|---|---|---|---|---|
| 4,109,879 | A * | 8/1978 | Properzi | 242/361 |
| 5,238,199 | A | 8/1993 | Ossoinig et al. | |
| 2006/0217831 | A1 * | 9/2006 | Butterworth et al. | 242/534.2 |

FOREIGN PATENT DOCUMENTS

| | | |
|---|---|---|
| DE | 3023308 | 2/1981 |
| JP | 57154320 | 9/1982 |
| JP | 61123417 | 6/1986 |

* cited by examiner

*Primary Examiner* — Teresa M Ekiert
(74) *Attorney, Agent, or Firm* — Seyed Kaveh E. Rashidi-Yazd

(57) ABSTRACT

A method is disclosed for controlling the speed of a curved rotatably driven laying pipe through which a longitudinally moving product is directed to exit from the delivery end of the pipe as a helical formation of rings. The method comprises determining the maximum and minimum internal radii $R_{max}$, $R_{min}$ of the pipe at the location of the maximum radius R of the pipe as measured from its rotational axis; continuously measuring the velocity $V_p$ of the product entering the laying pipe; and, controlling the rotational speed of the laying pipe such that the rotational velocities $V_{max}$, $V_{min}$ of the pipe at said maximum and minimum internal radii bracket a range containing the velocity $V_p$ of the product.

4 Claims, 3 Drawing Sheets

METHOD OF CONTROLLING THE SPEED OF A LAYING HEAD IN A ROLLING MILL

CROSS REFERENCE TO RELATED APPLICATIONS

This application claims priority from provisional patent application Ser. No. 60/909,548 filed Apr. 2, 2007.

BACKGROUND DISCUSSION

1. Field of the Invention

This invention relates generally to rolling mills where hot rolled products, typically rods and bars, are formed into rings by a laying head, and the rings are deposited in an overlapping Spencerian pattern on a conveyor where they undergo controlled cooling while being transported to a reforming station. The invention is concerned in particular with an improved method for controlling the rotational speed of the laying head so as to optimize the pattern of rings deposited on the conveyor.

2. Description of the Prior Art

In order to cool the rings being transported on the conveyor in a substantially uniform manner, the ring pattern should optimally be substantially uniform. In order to achieve a substantially uniform ring pattern, the laying head speed should be matched to the velocity of the product. Since the product velocity will vary from time to time due to changing rolling conditions, the laying head speed must be correspondingly adjusted, with failure to do so in a timely fashion resulting in a disruption of the ring pattern on the conveyor.

In the past, laying head speeds have been controlled manually by operating personnel based on their observation of the ring pattern on the conveyor. Thus, differences between product velocities and laying head speeds are not detected and addressed until they begin to distort the ring pattern, which in turn adversely affects uniformity of cooling. This problem is exacerbated where operating personnel are inexperienced and/or inattentive to the mill's changing conditions.

The objective of the present invention is to provide an improved method of maintaining an optimum relationship between product velocity and laying head speed.

SUMMARY OF THE INVENTION

As depicted schematically in FIG. 3, the laying pipe 10 of a rolling mill laying head is typically configured with a straight entry section 10*a* aligned with the rotational axis A of rotation of the laying pipe, a curved intermediate section 10*b* having a gradually increasing radius as measured from axis A, and a curved delivery section 10*c* having a constant radius equal to the maximum radius R of the intermediate section 10*b* at the location of its juncture with the delivery section.

As shown in FIG. 4, the radius R is measured from the center of the pipe, with the pipe wall at this location having maximum and minimum internal radii $R_{max}$, $R_{min}$.

In accordance with the present invention, the maximum and minimum internal radii of the laying pipe are determined as measured from the rotational axis of the pipe. The velocity of the product entering the laying pipe is measured continuously, and the rotational speed of the laying pipe is controlled such that the velocities of the pipe at its maximum and minimum internal radii bracket a range containing the velocity of the product.

The invention will now be described in further detail with reference to the accompanying drawings, wherein:

DETAILED DESCRIPTION

Figure 1:
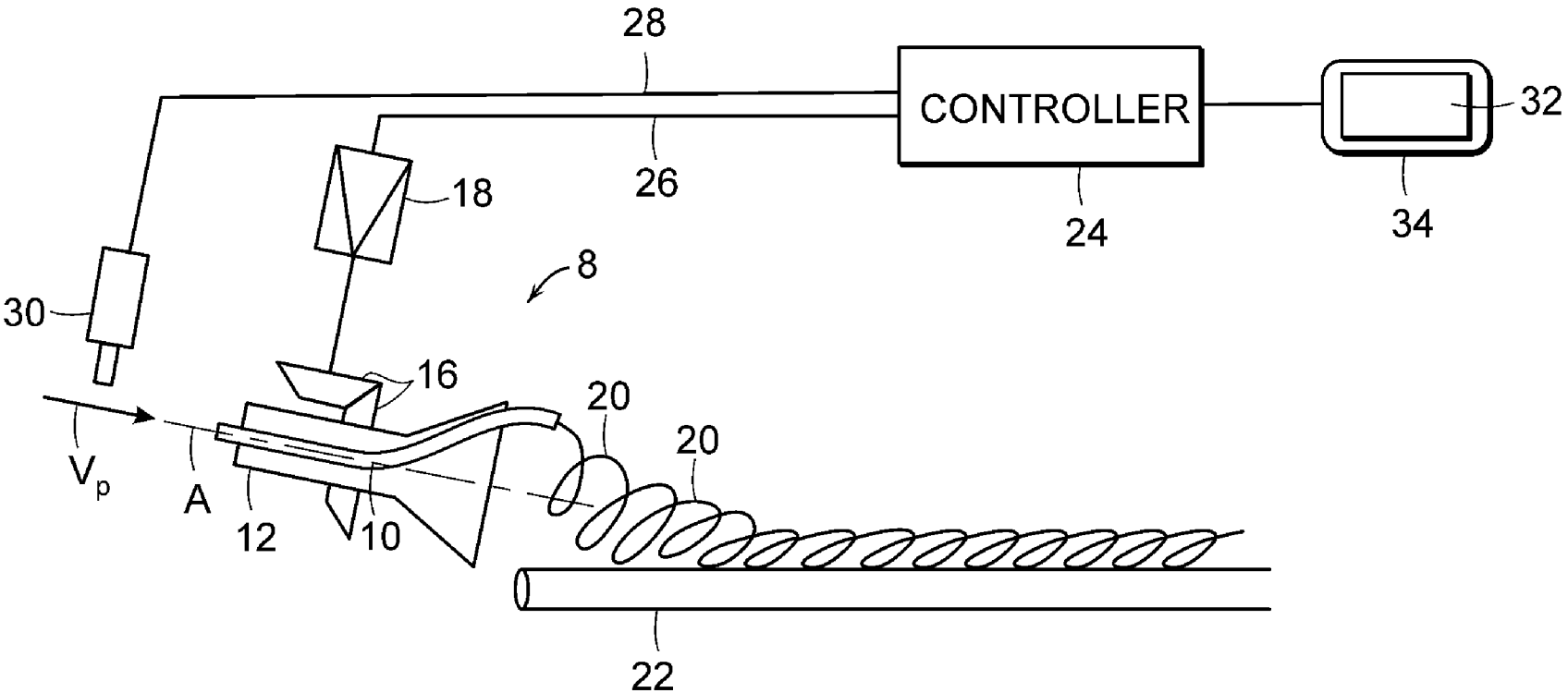
FIG. 1 is a schematic illustration of a system useful in the practice of the present invention.

With reference initially to FIG. 1, a laying head 8 includes a hollow quill 12 containing a laying pipe 10. A bevel gear set 16 powered by a motor 18 serves to rotatably drive the laying head about its axis "A".

A longitudinally moving product, e.g., a hot rolled rod or bar, enters the rotating laying pipe along axis A and is formed into a helical series of rings 20 that are received in an overlapping Spencerian pattern on a conveyor 22. In a known manner, the rings are subjected to controlled cooling as they are being transported on the conveyor to a remote reforming station (not shown).

In accordance with the present invention, the maximum and minimum internal radii $R_{max}$, $R_{min}$ are determined as measured from the rotational axis A. These measurements are provided to a controller 24 along with signals 26, 28 representative respectively of the speed of motor 18 and the linear velocity $V_p$ of the product entering the laying pipe 10. Product velocity is measured continuously, preferably by a laser gauge 30, an example of which is the "Laser Speed" supplied by the Morgan Construction Company of Worcester, Mass., U.S.A.

It has been determined that an optimum and substantially uniform pattern of rings on the conveyor 22 can be maintained if the linear product velocity $V_p$ is positioned optimally within a range bracketed by the rotational velocities $V_{max}$, $V_{min}$ of the laying pipe at its maximum and minimum internal radii $R_{max}$, $R_{min}$.

Accordingly, the controller 24 continuously calculates $V_{max}$, $V_{min}$ and visually displays the results on the screen 32 of a monitor 34 along with the velocity $V_p$ of the product. This information is displayed on the screen 32 as shown in FIG. 2A. Here, product velocity $V_p$ is optimally positioned within the range RA bracketed by the maximum and minimum internal velocities $V_{max}$, $V_{min}$ of the laying pipe.

Figure 2B:
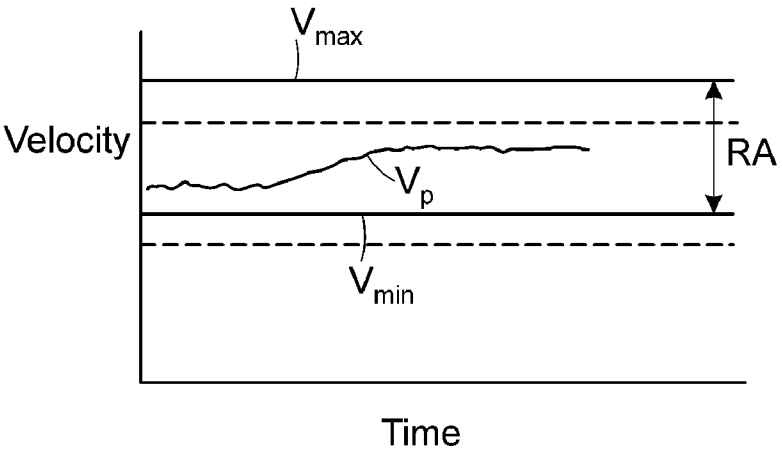
FIGS. 2A and 2B are graphic depictions of the velocity of the product as it relates to the velocities of the laying pipe at the maximum and minimum internal radii.
Figure 2A:
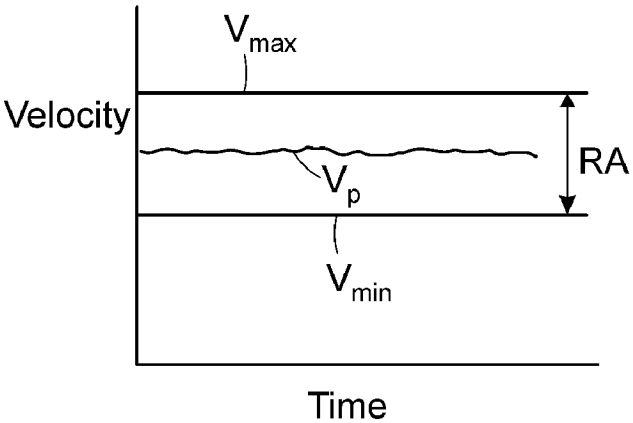
Figure 3:
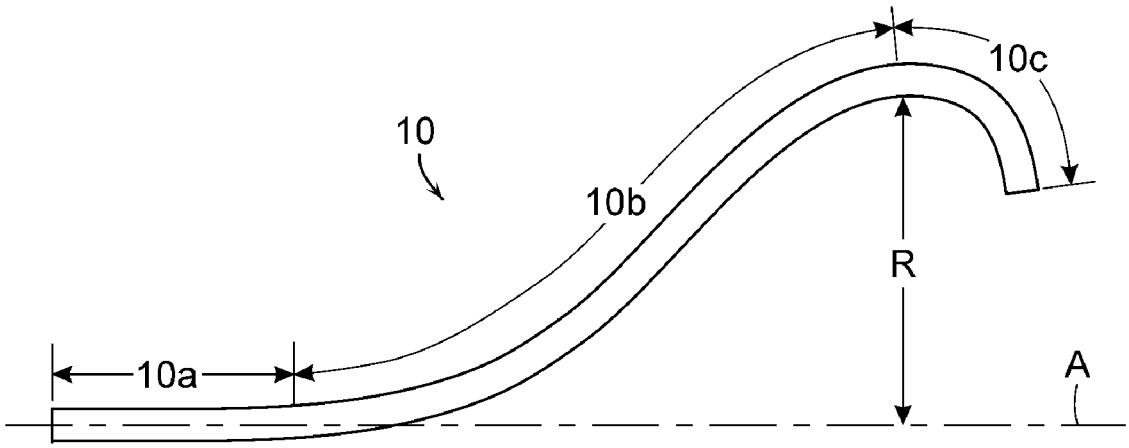
FIG. 3 is a schematic depiction of a laying pipe.
Figure 4:
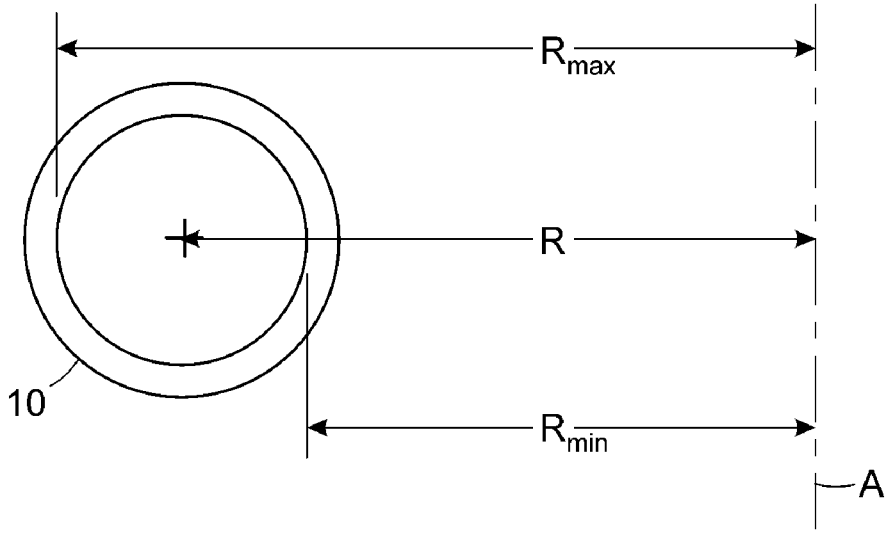
FIG. 4 is a cross sectional view taken through the laying pipe at the location of its maximum and minimum internal radii.

Should rolling conditions result in a change in product velocity, for example causing in an increase as shown in FIG. 2B, by observing monitor 34, operating personnel will be alerted immediately to the need to reposition the range RA by adjusting the speed of the laying head, in this disclosed example, by a speed increase, thus raising $V_{max}$ and $V_{min}$ from the prior setting (depicted by broken lines) to a new elevated setting which continues to position product speed optimally within the bracketed range.

These speed adjustments may be performed manually, or the controller 24 may be programmed in a known manner to do so automatically.

In light of the foregoing, it will now be appreciated by those skilled in the art that when initially rolling a product, $R_{max}$ and $R_{min}$ can be determined, and $V_{max}$, $V_{min}$ can be calculated and matched to an expected product velocity $V_p$. As rolling progresses, the range RA can be quickly adjusted, either manually or automatically, to achieve optimum bracketing of $V_p$ in order to obtain and maintain an optimum ring pattern on the conveyor.

I claim:

1. A method of controlling the rotational speed of a curved rotatably driven laying pipe into which a longitudinally moving product is directed at a velocity $V_p$ and from which the product exits at a delivery end of said pipe as a helical formation of rings, said method comprising:

determining maximum and minimum internal radii $R_{max}$, $R_{min}$ of said pipe at a location of the maximum radius R of said pipe as measured from the rotational axis of said pipe;

continuously measuring the velocity $V_p$; and controlling the rotational speed of said pipe such that the rotational velocities $V_{max}$, $V_{min}$ of said pipe at said maximum and minimum internal radii bracket a range containing the velocity $V_p$ of said product.

2. The method of claim 1 further comprising visually displaying $V_{max}$, $V_{min}$, and $V_p$.

3. The method of claim 2 wherein the rotational speed of said pipe is controlled manually.

4. The method of claim 1 wherein the rotational speed of said pipe is controlled automatically.

* * * * *